US008136325B1

(12) United States Patent
Van Lerberg et al.

(10) Patent No.: US 8,136,325 B1
(45) Date of Patent: Mar. 20, 2012

(54) LANDSCAPING WALL STRUCTURE AND FORM

(76) Inventors: David P. Van Lerberg, Kansas City, MO (US); Darren A. O'Rourke, Wellsville, KS (US)

( * ) Notice: Subject to any disclaimer, the term of this patent is extended or adjusted under 35 U.S.C. 154(b) by 537 days.

(21) Appl. No.: 11/254,319

(22) Filed: Oct. 20, 2005

(51) Int. Cl.
*E04B 5/04* (2006.01)

(52) U.S. Cl. ..... 52/604; 52/592.3

(58) Field of Classification Search ..... 52/604, 52/608, 609, 592.2, 592.3
See application file for complete search history.

(56) References Cited

U.S. PATENT DOCUMENTS

| | | | | |
|---|---|---|---|---|
| 887,814 | A | 5/1908 | Johnson | |
| 1,130,324 | A * | 3/1915 | Owen | 446/127 |
| 1,534,353 | A | 4/1925 | Besser | |
| 1,634,357 | A | 7/1927 | Himmelright | |
| 1,678,613 | A | 7/1928 | Weiss | |
| 2,118,544 | A | 5/1938 | Asbury | |
| 2,313,363 | A * | 3/1943 | Schmitt | 405/286 |
| 2,478,736 | A | 8/1949 | Balzer | |
| 2,688,245 | A | 9/1954 | Vesper | |
| 3,940,229 | A * | 2/1976 | Hutton | 425/436 R |
| 3,981,953 | A * | 9/1976 | Haines | 264/163 |
| 4,063,866 | A | 12/1977 | Lurbiecki | |
| 4,094,788 | A | 6/1978 | Dockery | |
| 4,223,377 | A | 9/1980 | Williams | |
| 4,426,100 | A | 1/1984 | Yamabe et al. | |
| 4,790,508 | A | 12/1988 | Henderson et al. | |
| 4,815,897 | A | 3/1989 | Risi et al. | |
| 4,909,717 | A | 3/1990 | Pardo | |
| 4,992,005 | A | 2/1991 | Hilfiker | |
| 5,062,610 | A | 11/1991 | Woolford et al. | |
| 5,230,195 | A | 7/1993 | Sease | |
| 5,294,216 | A | 3/1994 | Sievert | |
| 5,337,527 | A | 8/1994 | Wagenaar | |
| 5,402,609 | A | 4/1995 | Kelley, Jr. | |
| 5,484,236 | A * | 1/1996 | Gravier | 405/286 |
| 5,490,363 | A | 2/1996 | Woolford | |
| D370,272 | S | 5/1996 | Risi et al. | |
| 5,589,124 | A | 12/1996 | Woolford et al. | |
| 5,622,456 | A * | 4/1997 | Risi et al. | 405/284 |
| 5,647,185 | A | 7/1997 | Forlini | |
| 5,683,170 | A | 11/1997 | Blaha | |
| 5,791,827 | A | 8/1998 | Arvai et al. | |
| 5,817,248 | A | 10/1998 | Forlini | |
| 5,827,015 | A | 10/1998 | Woolford et al. | |
| 6,029,943 | A | 2/2000 | Sievert | |
| 6,138,983 | A | 10/2000 | Sievert | |
| 6,178,704 | B1 | 1/2001 | Sievert | |
| 6,183,168 | B1 | 2/2001 | Woolford et al. | |

(Continued)

*Primary Examiner* — Jessica Laux
(74) *Attorney, Agent, or Firm* — Intellectual Property Center, LLC; Arthur K. Shaffer

(57) ABSTRACT

In an embodiment of the present invention, the foregoing is addressed by providing a combination retaining wall structure and masonry form apparatus comprising a first block having a depending lip with non-linear edge, a second block having an upper surface with a recess presenting an inwardly facing edge, the second block being positioned with respect to a rotational axis through the first block. A zone of contact is located at the intersection of the inwardly facing edge and the outwardly facing edge, providing an area for rotation of the first block about the rotational axis of the second block. The first and second blocks forming a non-linear masonry wall structure having an upright axis, about which plural blocks may be rotated. The depending lip and recess being provided by a masonry form having a first, second, third and fourth sides, the first and second sides being removable for interchangeably configuring the first and second block.

14 Claims, 9 Drawing Sheets

U.S. PATENT DOCUMENTS

| | | | | |
|---|---|---|---|---|
| 6,224,815 | B1 | 5/2001 | LaCroix et al. | |
| 6,499,432 | B2 | 12/2002 | Ogawa | |
| 6,523,317 | B1 | 2/2003 | Bott et al. | |
| 6,557,818 | B2 | 5/2003 | Manthci | |
| 6,578,321 | B2 | 6/2003 | Layne | |
| 6,616,382 | B2 * | 9/2003 | Woolford et al. | 405/284 |
| 6,620,364 | B2 * | 9/2003 | Gresser et al. | 264/219 |
| 6,679,656 | B1 | 1/2004 | Manthei | |
| 6,682,269 | B2 | 1/2004 | Price et al. | |
| 6,715,965 | B2 * | 4/2004 | Manthei et al. | 405/284 |
| 6,796,098 | B2 * | 9/2004 | Hampton | 52/603 |
| 6,829,867 | B2 | 12/2004 | Gresser et al. | |
| 7,207,146 | B1 * | 4/2007 | Morrell | 52/561 |
| 2003/0160147 | A1 | 8/2003 | Manthei | |
| 2004/0065042 | A1 * | 4/2004 | Gresser et al. | 52/604 |
| 2004/0098938 | A1 * | 5/2004 | Nordstrand | 52/316 |
| 2004/0151550 | A1 | 8/2004 | Price et al. | |
| 2004/0184263 | A1 | 9/2004 | Patti | |
| 2004/0218985 | A1 | 11/2004 | Klettenberg et al. | |

* cited by examiner

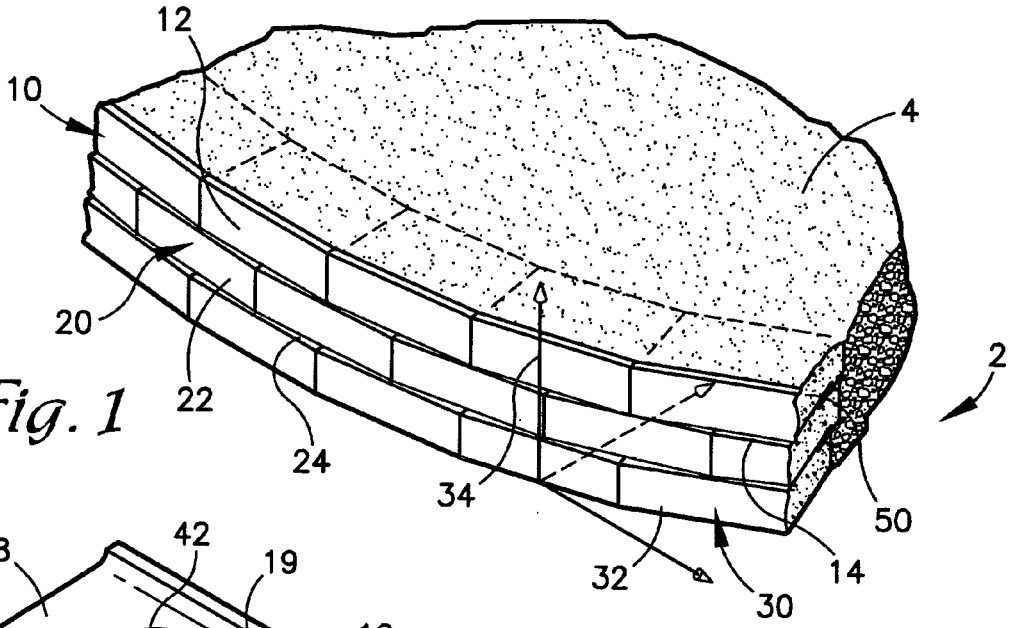
Fig. 1
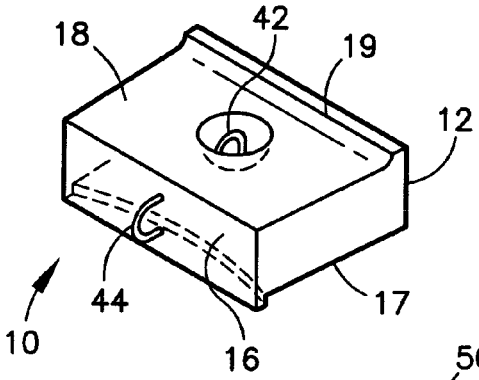
Fig. 2
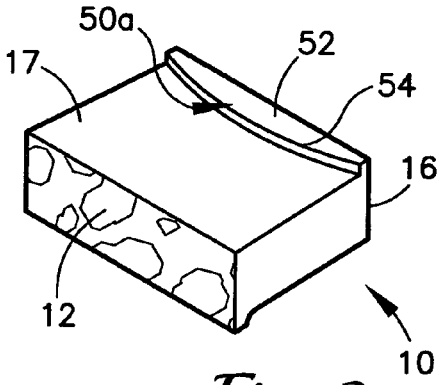
Fig. 3
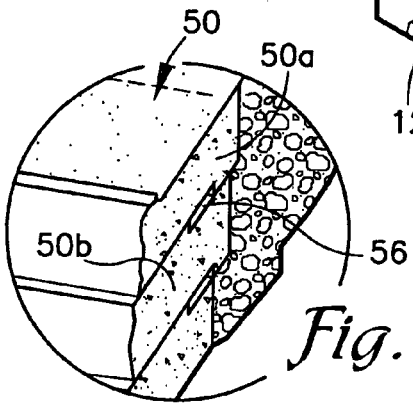
Fig. 1A
Fig. 4
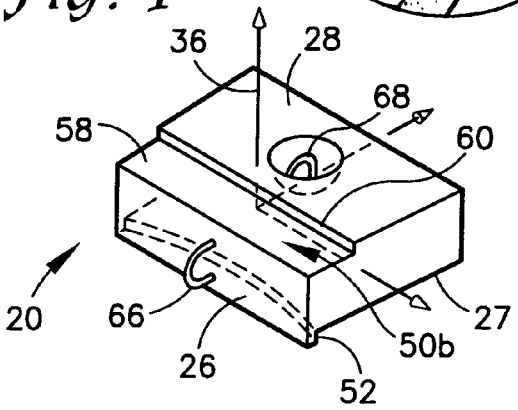
Fig. 5
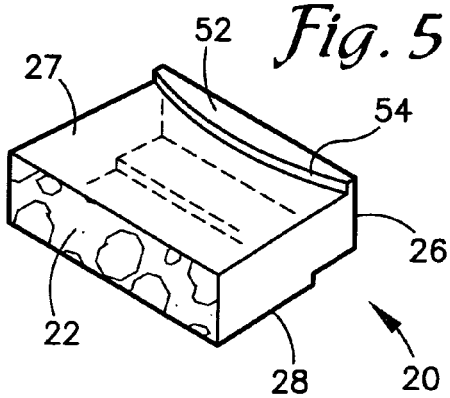

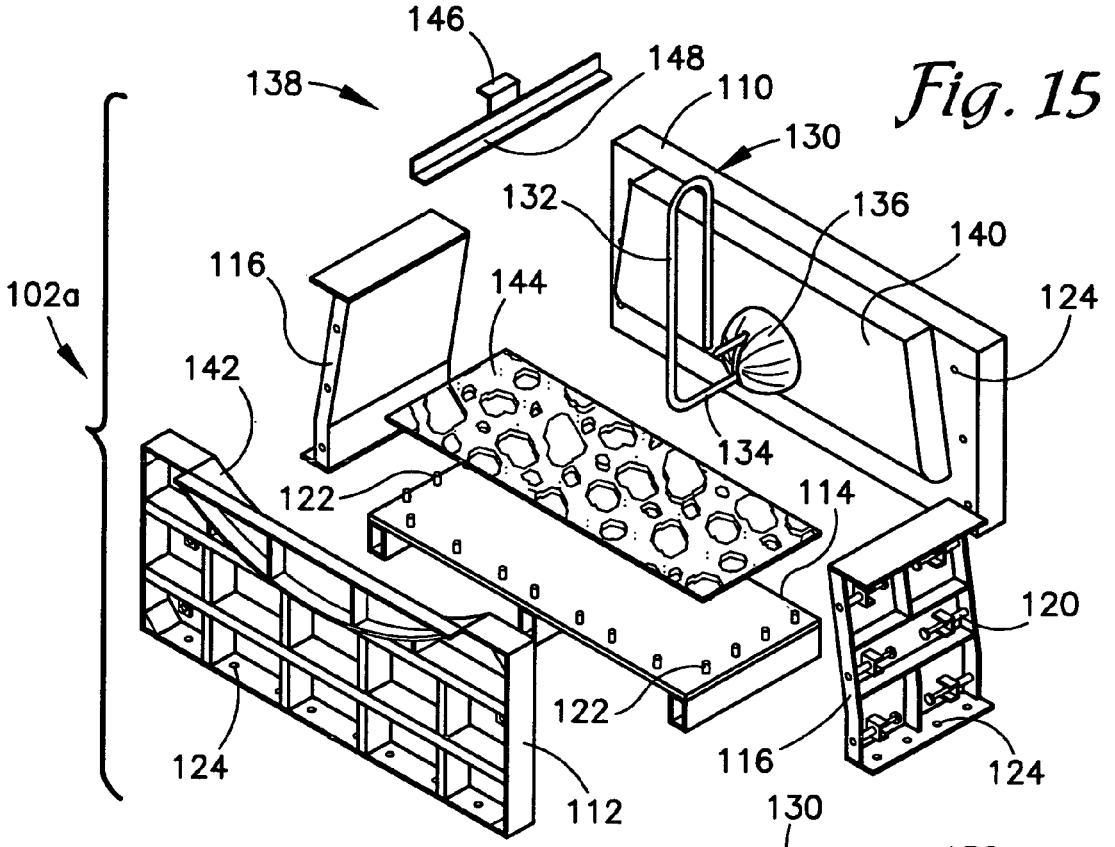
Fig. 15
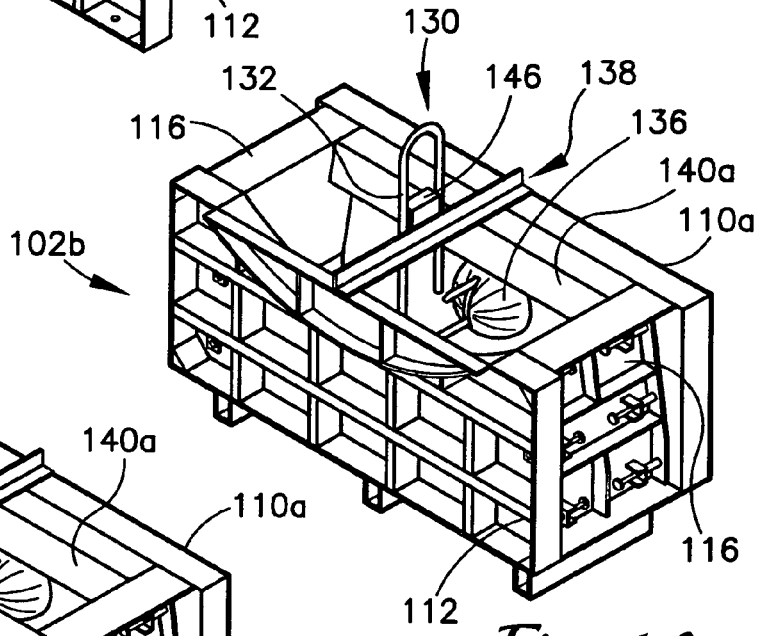
Fig. 16
Fig. 17
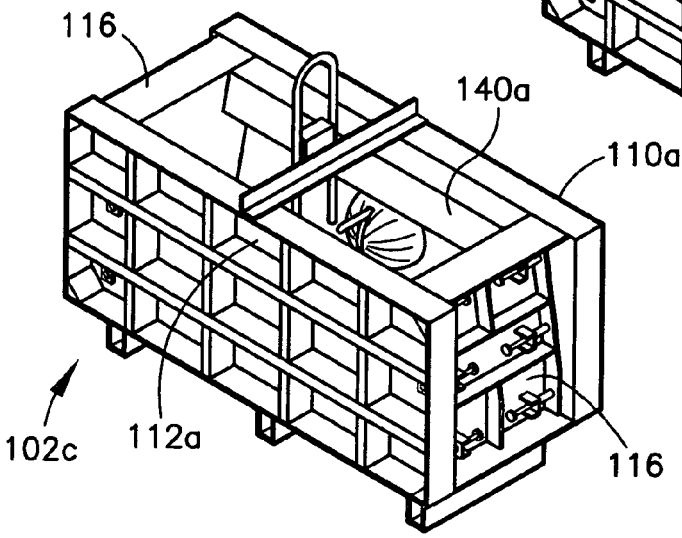

Fig. 20
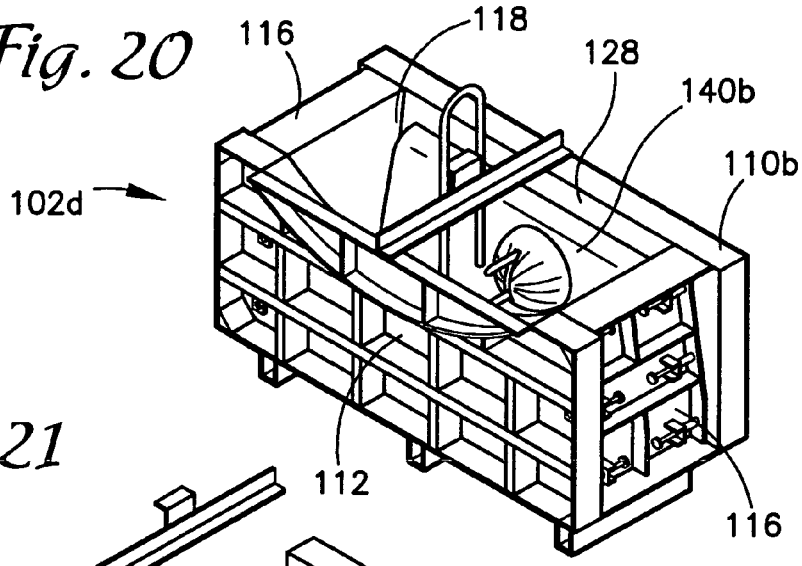
Fig. 21
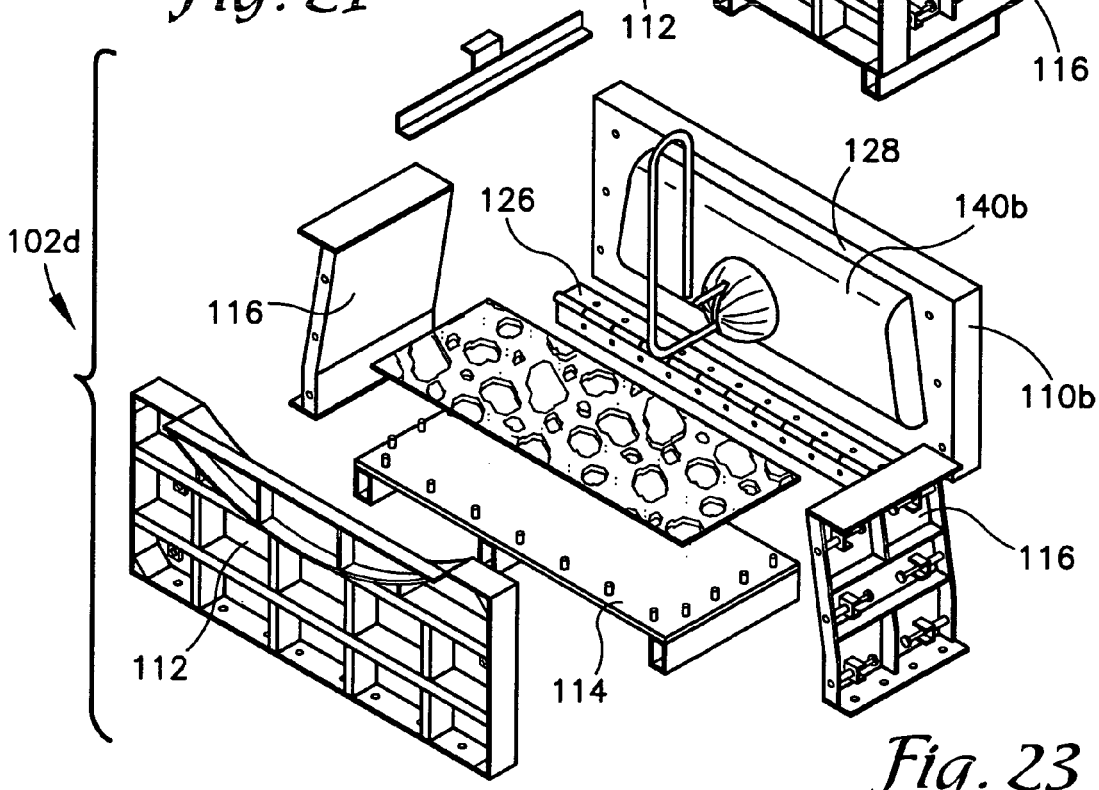
Fig. 23
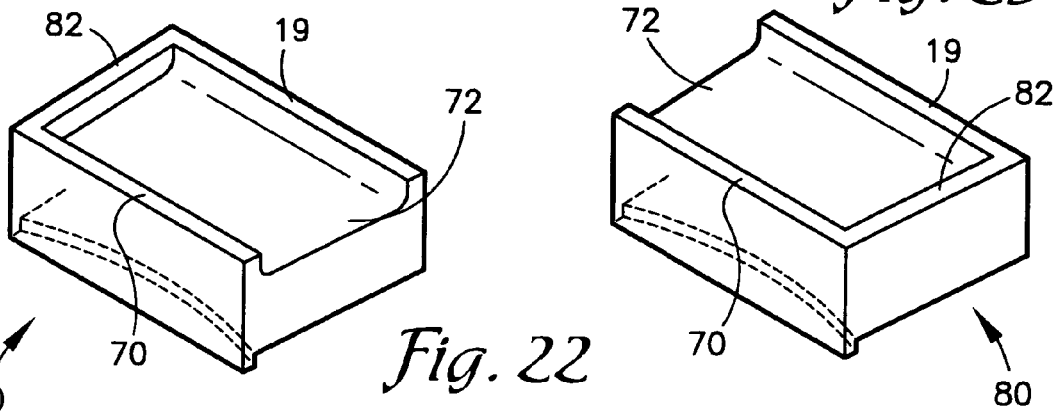
Fig. 22

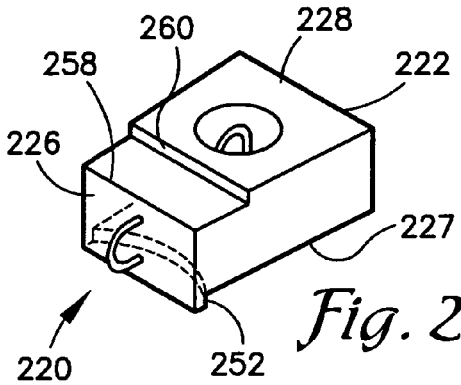
Fig. 28
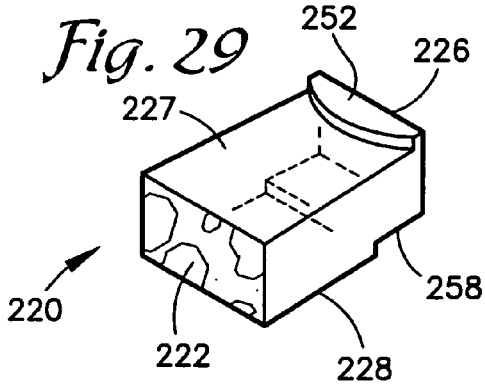
Fig. 29
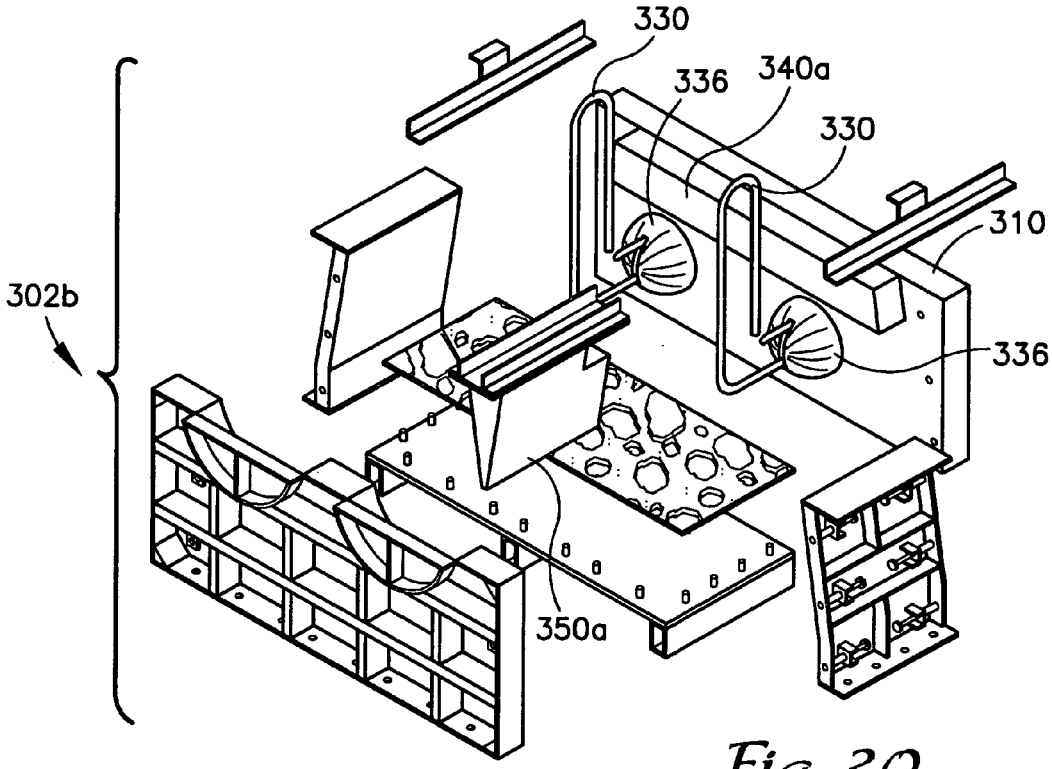
Fig. 30
Fig. 31
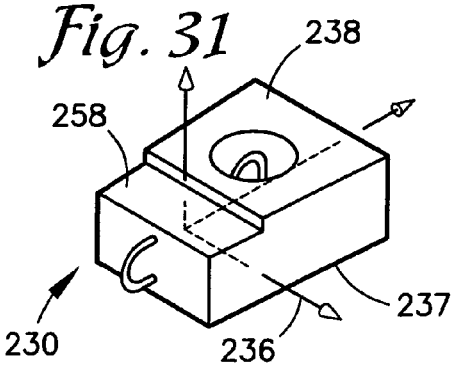
Fig. 32
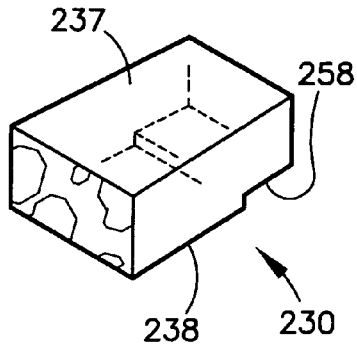

LANDSCAPING WALL STRUCTURE AND FORM

CROSS-REFERENCE TO RELATED APPLICATION

This application claims the benefit of U.S. co-pending non-provisional application Ser. No. 11/243,034 filed Oct. 3, 2005 which is incorporated herein by reference.

FIELD OF THE INVENTION

The present invention relates in general to masonry blocks for use in connection with landscaping, and more specifically to the masonry block manufacturing process and the resultant masonry blocks which may be used as a landscaping supporting element in connection with retaining walls.

BACKGROUND OF THE INVENTION

Landscape retaining walls are currently used in a variety of places for a variety of reasons such as soil retention, protection of structures and for aesthetic effects on commercial, residential, industrial and agriculture facilities. For example, with the development of a commercial facility, an owner may need to build a retaining wall to protect the structure from water damage or from soil erosion associated with the water. However, the facility may have a nonlinear soil contour surrounding the facility. Some retaining wall structures may limit the ability of the retaining wall from adapting to the contour of the surrounding soil. Other's while permitting adjustment, may only provide limited rotation or rotation based upon the use of a hemispherical center section. The spherical center section may provide structure for securing the retaining wall structure; however, the section does not prevent the structure from rotation after being secured together. It would therefore, be beneficial to provide an adjustable retaining wall structure having a new manner of rotation, allowing the retaining wall structure to match the soil's contour.

Retaining wall form molds are typically used to create a retaining wall structure, the form molds being adapted to receive typical masonry materials. These molds may be adapted for creating structure within the masonry material, as the material cures. However, the molds may provide a static configuration, limiting the adaptability of the forms to one retaining wall structure. Others, while allowing for some modification, may not provide for an interlocking structure between different retaining wall structures. Additionally, some retaining wall structures may utilize reinforcement means imbed through into the wall structure. However, the support for these reinforcement means may not be present in some of the available mold structures. In addition, because of the increasing use of retaining walls in a variety of locations and situations, it is becoming more popular to provide an aesthetically pleasing structure which blends into or enhances the surrounding environment. It would therefore be beneficial to provide an adaptable mold having a structure for supporting a reinforcement means, the adaptable structure providing a visually enhancing structure.

SUMMARY OF THE INVENTION

In an embodiment of the present invention, the foregoing is addressed by providing a combination retaining wall structure and masonry form apparatus comprising a first block having a depending lip with non-linear edge, a second block having an upper surface with a recess presenting an inwardly facing edge, the second block being positioned with respect to a rotational axis through the first block. A zone of contact is located at the intersection of the inwardly facing edge and the outwardly facing edge, providing an area for rotation of the first block about the rotational axis of the second block. The first and second blocks forming a non-linear masonry wall structure having an upright axis, about which plural blocks may be rotated. The depending lip and recess being provided by a masonry form having a first, second, third and fourth sides, the first and second sides being removable for interchangeably configuring the first and second block.

BRIEF DESCRIPTION OF THE DRAWINGS

FIG. 1 is a partial cut-away perspective view of an arrangement of masonry blocks into a retaining wall as an embodiment of the present invention; FIG. 1A is an enlarged fragmentary perspective view of a section of the retaining wall shown in FIG. 1 and provides an enlarged illustration of a zone of contact between an underlying block and an overlying block.

FIG. 2 is a rear perspective view of an embodiment of a top masonry block as shown in FIG. 1 with an arcuate surface illustrated in phantom line on the bottom of the block.

FIG. 3 is a front perspective view of the underside of a top masonry block as shown in FIG. 2, the top masonry block having a masonry relief illustrated on the front surface thereof.

FIG. 4 is a rear perspective view of an embodiment of a middle masonry block as shown in FIG. 1, the middle block having an arcuate surface in phantom line on the underside thereof.

FIG. 5 is a front perspective view of the underside of a middle masonry block as shown in FIG. 4, the middle block having a masonry relief illustrated on the front surface thereof.

FIG. 15 is an exploded perspective view of the top block masonry mold shown in FIG. 14.

FIG. 16 is a top perspective view of a middle block masonry mold in accordance with the present invention.

FIG. 17 is a top perspective view of the bottom block masonry mold in accordance with the present invention.

FIG. 20 is a top perspective view of an alternative top block masonry mold in accordance with the present invention.

FIG. 21 is an exploded perspective view of the alternative masonry mold shown in FIG. 20.

FIG. 22 is a front perspective view of an alternative top masonry block formed in accordance with the mold shown in FIG. 20.

FIG. 23 is a front perspective view of an alternative top masonry block formed in accordance with the mold shown in FIG. 20.

FIG. 28 is a rear perspective view of an alternative middle masonry block in accordance with the present invention.

FIG. 29 is a front perspective view of the underside of the middle masonry block as shown in FIG. 28, the middle block having a masonry relief illustrated on the front surface thereof.

FIG. 30 is an exploded perspective view of an alternative middle block masonry mold in accordance with the present invention.

FIG. 31 is a rear perspective view of an alternative bottom masonry block in accordance with the present invention.

FIG. 32 is a front perspective view of the underside of the bottom masonry block as shown in FIG. 31, the bottom block having a masonry relief illustrated on the front surface thereof.

DETAILED DESCRIPTION

Figure 6:
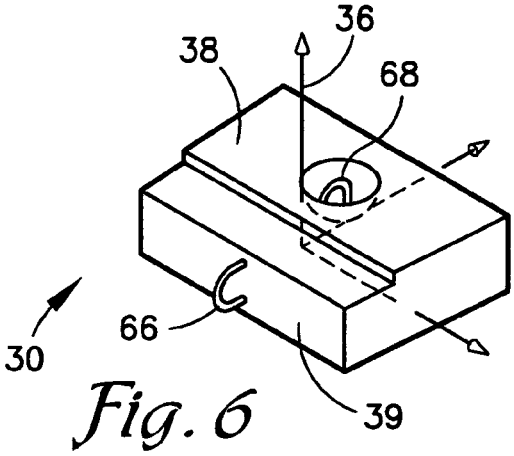
FIG. 6 is a rear perspective view of an embodiment of a bottom masonry block as shown in FIG. 1.

Certain terminology will be used in the following description for convenience in reference only and will not be limiting. For example, top, bottom, front, back, right and left refer to the illustrated embodiment as oriented in the view being referred to. The words "upwardly" and "downwardly" refer to directions up or down and away from, respectively, the geometric center of the embodiment being described and designated parts thereof. Such terminology will include the words specifically mentioned, derivatives thereof and words of similar meaning.

Referring to FIG. 1, a retaining wall generally referred to with reference numeral 2 is illustrated as having a combination of masonry blocks spatially arranged, the combination of blocks including a first block 10, a second block 20 and a third block 30. The retaining wall 2 illustrates the blocks 10, 20, 30 layered with an orientation with respect to an upright axis 34 of the retaining wall 2. A second setback 24 is illustrated extending from a third front surface 32 adjacent to the third block 30 to a second front surface 22 adjacent to the second block 20 and is created by staggering the second blocks 20 relative to the third blocks 30. A first setback 14 is illustrated extending from the second front surface 22 to a first front surface 12 adjacent to the first block 10 and is created by staggering the first blocks 10 relative to the second blocks 20. Blocks 10, 20, 30 rearwardly extend into a rear facing earth or landscaping surface 4, and the front surfaces, 12, 22, 32 provide a generally planar outwardly facing surface which optionally presents a masonry relief surface.

FIG. 2 illustrates a rear surface 16 of the first block 10 having a generally rectangular shape reinforced with a plurality of optional reinforcement bars 42, 44 composed of structural grade materials extending vertically and horizontally through an upper surface 18 and the rear surface 16 of the first masonry block 10. The upper surface reinforcement bar 42 is recessed within the upper surface 18 providing a substantially planar upper surface 18 while the rear surface reinforcement bar 44 extends outwardly from the rear surface 16 of the masonry block 10. The reinforcement bars 42, 44 are generally adapted to provide additional strength to the masonry block 10 while securing the block 10 during transportation from and to a destination point.

An upwardly extending ledge 19 is illustrated in FIG. 2 extending from said upper surface 18 at said front surface 12, the ledge 19 defining a parabolic region in the upper surface 18 of the first block 10. The ledge 19 extends upwardly from said upper surface 18 at said parabolic region which is adapted for integrating the retaining wall into the earth 4. The ledge 19 separates the parabolic region from the front surface 12. The integrated wall 2 may be utilized to provide a façade relief for visual enhancement or to provide additional support for the wall 2.

As illustrated in FIG. 1, plural masonry blocks are positioned and arranged in relation to the upright axis 34 associated with the retaining wall 2. The blocks 10, 20, 30 are vertically and horizontally arranged with an interlocking structure 50 having an upper structure 50*a* (FIG. 1A) and a lower structure 50*b* which are adapted for rotation and setback of the vertically arranged blocks 10, 20, 30.

Figure 10:
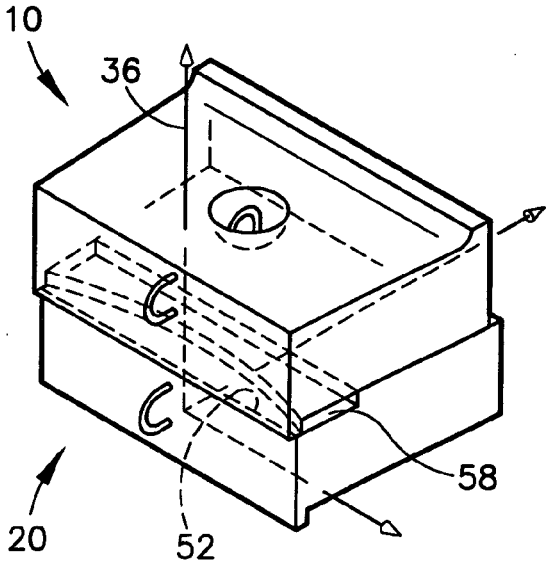
FIG. 10 is a rear perspective view of the top block received by the middle block.
Figure 11:
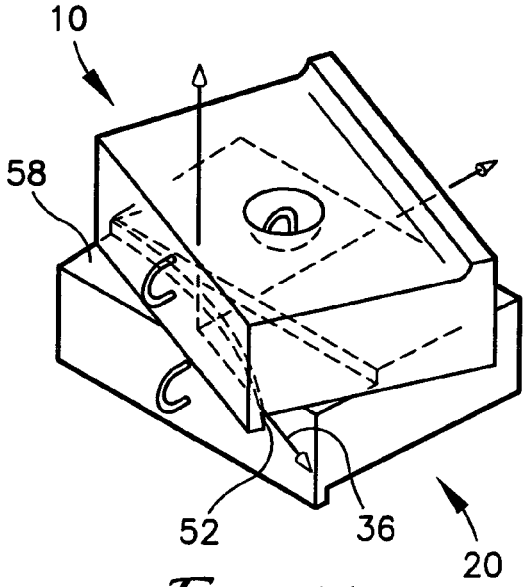
FIG. 11 is a rear perspective view of the assembled blocks as shown in FIG. 15 in which the top block is rotated in relation to the middle block.

In general, as illustrated in FIGS. 10-11, the present invention provides for the rotation of an overlying block, such as the first block 10, about a rotational axis 36 of an underlying block, such as the second block 20. The rotational axis 36 may have the same orientation as the retaining wall upright axis 34 as illustrated in FIG. 1 or it may vary depending on the underlying block. In general, the overlying block may include, but is not limited to, the first or second blocks 10, 20 while the underlying block may generally include, but is not limited to, the second or third blocks 20, 30. The retaining wall includes the first block 10 overlying the second block 20, the second block 20 overlying the third block 30, with additional optional layers of the second block 20 overlying another second block 20 in the preferred configuration of the retaining wall 2.

In FIG. 3 an illustration of the upper structure 50*a* includes a depending lip 52 which is shown as extending from the rear surface 16, having a non-linear outwardly facing edge 54 and extending from a bottom surface 17 of the masonry block 10. The non-linear edge 54 provides for rotation or angular positioning of the block 10 about the rotational axis 36 (shown in FIG. 4) allowing the block 10 to adjust to the contour of the earth surface 4 or other rear facing landscaping surfaces. Although the non-linear edge 54 is illustrated as being arcuate or curved and convex, the edge may have alternative configurations which provide for the rotation of the masonry block 10 about the rotational axis 36.

Another illustration of the interlocking structure 50 is depicted in FIG. 4 in which the lower structure 50*b* is illustrated as being associated with the upper surface 28 and presenting an inwardly facing edge 60 on the second block 20. The inwardly facing edge 60 is illustrated in FIG. 4 as straight or planar. A recessed portion 58, illustrated in FIG. 4 as extending from the rear surface 26, is adapted for receiving the depending lip 52 at a zone of contact 56 illustrated in FIG. 1A. The zone of contact 56 provides for the rotation or angular positioning of the first block 10 about the rotational axis 36 of the second block 20 through a range of angles between the first block 10 and the second block 20 which maintains the zone of contact 56 (see FIGS. 1A and 11), the zone of contact 56 being located at the junction of the inwardly facing edge 60 and the outwardly facing edge 54 illustrated in FIG. 3, the zone of contact 56 extending along the width of the inwardly facing edge 60.

FIGS. 4-5 illustrate the second masonry block 20 in which the rear surface 26 has a generally rectangular shape. The second block is also illustrated with optional first and second rebar-sections 66, 68 vertically and horizontally extending from the upper and rear surfaces 26, 28 of the masonry block 20 to assist in locating the masonry block 20. The depending lip 52 is also illustrated extending from the bottom surface 27, providing for the vertical arrangement of plural blocks in an interlocking configuration. The depending lip 52 is adapted for being received by the complementary recessed portion 58 associated with the underlying block.

FIG. 5 illustrates the bottom surface 27 of the second masonry block 20 with the depending lip 52 extending from the bottom surface 27. The non-linear edge 54 provides for rotation of the block 20 about the underlying block's rotational axis 36 illustrated in FIG. 4 allowing the block 20 to adjust to the contour of the earth surface 4 or other rear facing landscaping surfaces. The second masonry block 20 optionally includes a masonry relief surface 22 for visually enhancing the retaining wall's front surface 2.

When the first and second masonry blocks 10, 20 are collectively arranged in FIGS. 10 and 11, the underlying, second block 20 contains the rotational axis 36 around which the overlying first block 10 may be rotated. FIG. 10 illustrates the blocks vertically aligned. The first and second blocks 10, 20 are rotated in FIG. 11, with the depending lip 52 of the first block 10 engaging the recessed portion 58 of the second block 20. The first block 10 is rotated about the rotational axis 36 of the second block 20 while the depending lip 52 of the first block 10 is secured within the recessed portion 58 of the second block 20. In this manner, the masonry blocks 10, 20 may form the retaining wall 2 generally having a curvature which may vary 60 degrees of rotation along the rotational axis 36 of the second block 20 through a range generally between −30 to 30 degrees from the retaining wall's upright axis 34.

Figure 7:
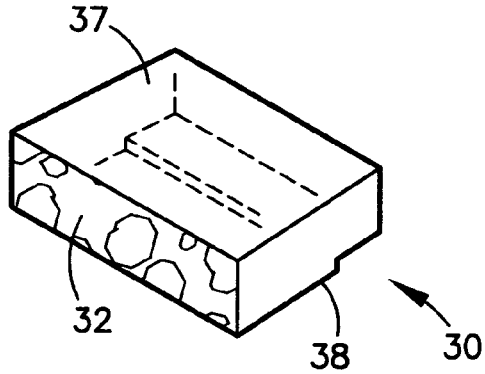
FIG. 7 is a front perspective view of the underside of the bottom masonry block as shown in FIG. 6, the bottom block having a masonry relief illustrated on the front surface thereof.

FIGS. 6-7 illustrate the third masonry block 30 in which an upper surface 38 is adapted for receiving at least one overlying block which may be either the first or second masonry block 10, 20 described above. FIG. 6 illustrates a rear surface 39 of the third block 30 having a generally rectangular shape optionally reinforced with a plurality of rebar sections 66, 68 vertically and horizontally extending from the upper and rear surfaces 38, 39 of the masonry block 30. The zone of contact 56 as illustrated in FIG. 1A allows for the rotation of the overlying block (not shown) about the rotational axis 36 of the third block 30. When the third block 30 is overlying the earth 4, in a general horizontal alignment, the rotational axis 36 of the third block 30, may be aligned with the upright axis 34 of the retaining wall 2.

FIG. 7 illustrates a bottom surface 37 of the third block 30 being substantially planar for positioning the masonry block 30 between the earth surface 4 and the overlying block, allowing the overlying block to rotate about the rotational axis 36 which may be aligned with the upright axis 34 of the retaining wall 2. In addition, the third block 30 optionally includes a masonry relief surface 32.

Figure 8:
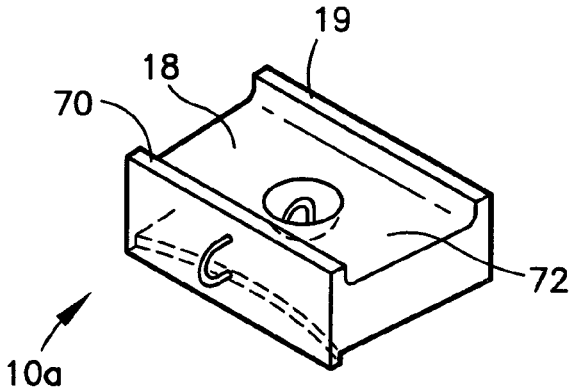
FIG. 8 is a rear perspective view of an alternative configuration of the top masonry block.
Figure 9:
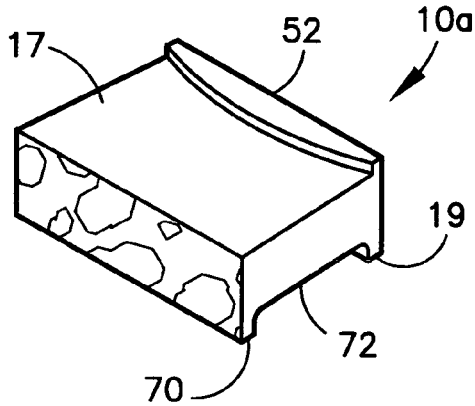
FIG. 9 is a front perspective view of the alternatively configured top block having a masonry relief illustrated thereon.

FIGS. 8 and 9 illustrate an alternative configuration of the first block 10*a* including a second upwardly extending ledge 70, separated from and substantially parallel to the first upwardly extending ledge 19 by a fluid receiving structure 72. FIG. 9 illustrates the block 10*a* having an interlocking structure which is illustrated extending from the bottom surface 17 opposite the fluid receiving structure 72 as the depending lip 52.

Figure 13:
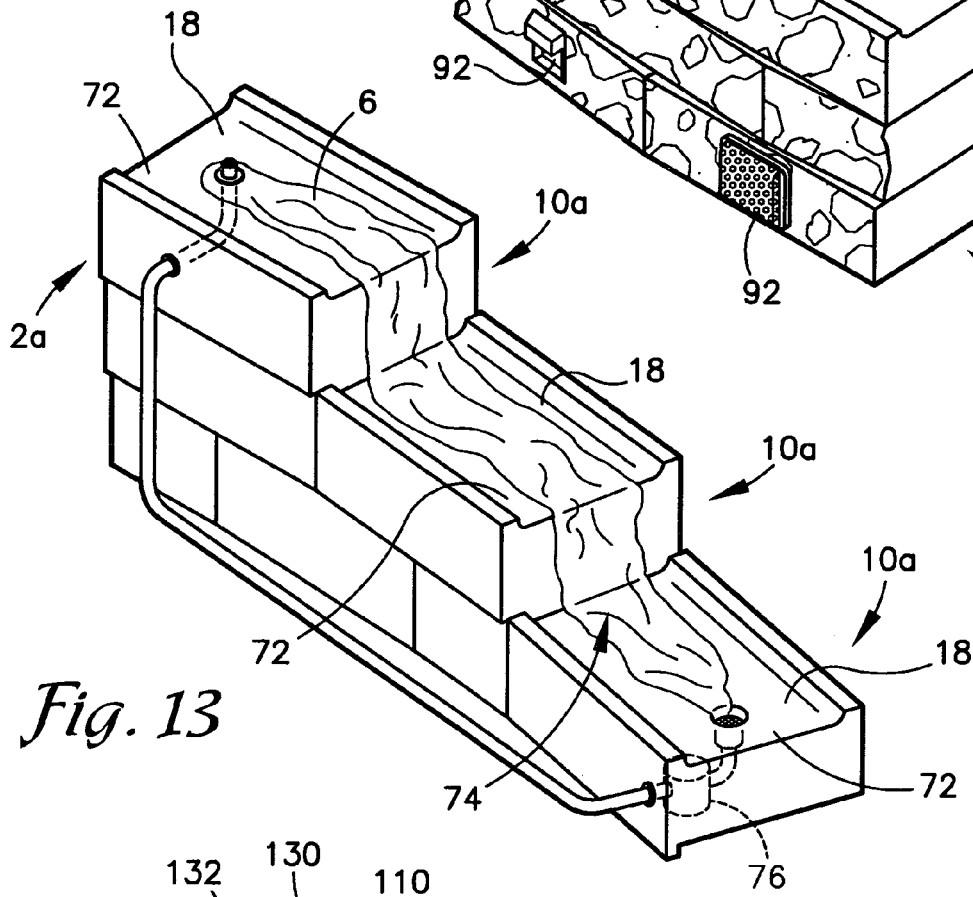
FIG. 13 is a rear perspective view of an alternative retaining wall arrangement with an alternative top block.

As illustrated in FIG. 13, plural, adjacently positioned first blocks 10*a* with a fluid receiving structure 72 arranged to provide a fluid conduit 74 which is adapted for transmitting a fluid 6 latitudinally across an upper surface 18 of the blocks 10*a*, along a retaining wall 2A. A fluid handling device 76 such as but not limited to a submersible pump, may be utilized for transporting the fluid 6 along the wall 2A. Although the fluid handling device 76 is illustrated as being integrally located within the block 10*a*, it is not limited to such a configuration and may alternatively be located adjacent to or in association with the fluid conduit 74.

Figure 24:
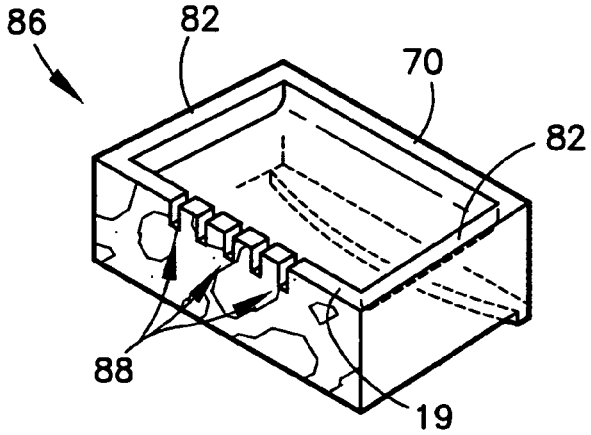
FIG. 24 is a front perspective view of an alternative top masonry block in accordance with the present invention.

In addition, as illustrated in FIGS. 22-23, alternatively configured first blocks 80 having an upwardly extending side ridge 82 extending between the first and second ledges 19, 70 may be utilized by the fluid conduit 74 illustrated in FIG. 13 to maintain the fluid movement. In addition, although FIG. 13 illustrates the fluid in fluidic communication along the generally horizontal fluid conduit 74 alternative configurations are possible utilizing an alternatively configured block 86. As illustrated in FIG. 24, the alternative block 86 includes at least one channel 88 traversing the first upwardly extending ledge 19, opposite the second upwardly extending ledge 70 for communicating the fluid 6 within the fluid receiving area generally defined by the first and second ledges 19, 70 and the side ridges 82, in a generally vertically descending direction.

Figure 12:
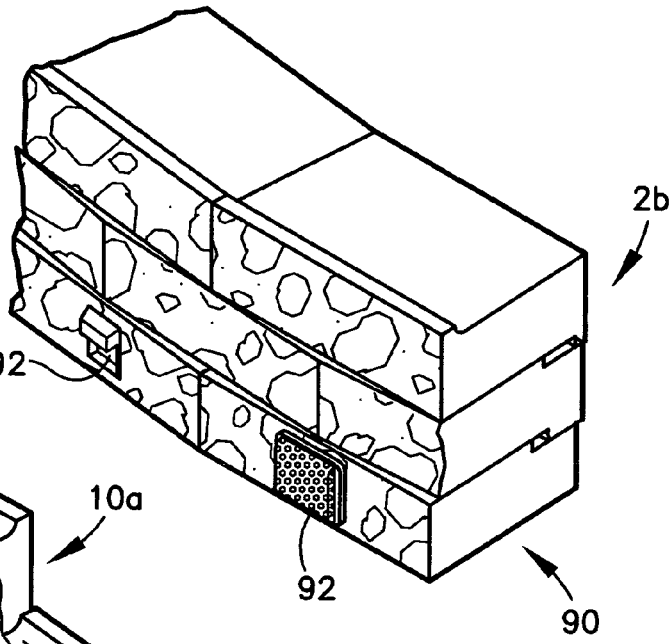
FIG. 12 is front perspective view of an alternative retaining wall arrangement with an alternative bottom block.

FIG. 12 illustrates a retaining wall 2B utilizing a third alternatively configured masonry block 90 in receipt of various electrical devices 92 such as but not limited to an illuminating device or an electroacoustic device. The alternative masonry block 90 may include an internally located electrical junction box, with an electrical conduit section extending from the electrical junction box through the rear of the block 90 allowing for the wiring of such electrical devices 92.

Figure 14:
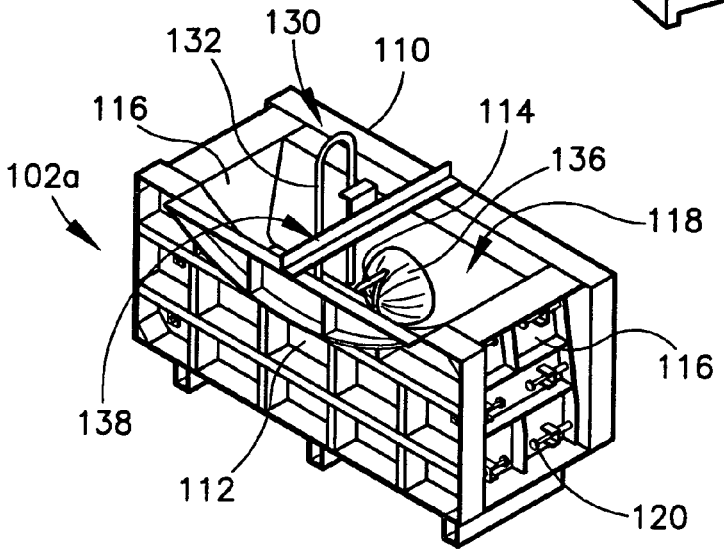
FIG. 14 is a top perspective view of a top block masonry mold in accordance with the present invention.

FIGS. 14-21 illustrate a masonry block form for forming the wall block structure which may include but is not limited to the first, second or third masonry blocks 10, 20, 30. In generally, the form has a first surface 110, a second surface 112, a third surface 116, a fourth surface 114 and a plurality of pin mechanisms 120 spaced along the fourth surface 114 for securely engaging the fourth surface 114 to the first, second and third surfaces 110, 112, 116. The form 102A of FIG. 14 is illustrated in a closed position with a reinforcement structure 130 having a horizontal and a vertical leg 134, 132 extending through a cavity 118 formed within the interior of the four engaged surfaces 110, 112, 114, 116.

The horizontal leg 134 of the reinforcement structure 130 extends though and is generally secured by a concentric receiver 136 located in association with the first surface 110. In addition, an elongated spacer 138 spans the first and second surfaces 110, 112, the elongated spacer 138 being adapted for receiving the vertical leg 132 of the reinforcement structure 130. When the cavity 118 of the masonry block form 102 is filled with a masonry material preferably made from commercial concrete materials, the reinforcement structure 130 provides a lift attachment for positioning and separating the formed wall structure from the form 102A.

In the exploded view of the masonry form 102A illustrated in FIG. 15, the reinforced structure 130 is illustrated with the horizontal leg 134 generally received by the concentric receiver 136 which extends from a spaced insert 140 located on the first surface 110. The spaced insert 140 illustrated in FIG. 15 may be adapted for forming different surfaces and is not limited to the upwardly extending ledge 19, associated with the first block 10 shown in FIG. 2. The second surface 112 in FIG. 15 is illustrated with a non-linear, generally arcuate recess 142 adapted for forming the depending lip 52 located in association with the bottom surface 17 of the first block 10 illustrated in FIG. 3. The recess 142 is generally opposite the fourth surface 114 and extends into the generally planar second surface 112. A relief plate 144 is positioned between the cavity 118 shown in FIG. 14 and the fourth surface 114 shown in FIG. 15, adapted for providing a masonry relief in association with the filled masonry material. The relief plate 144 may be fabricated from soft or hard material such as aluminum, silicon, rubber or another imprinted surface for providing masonry relief surface features associated with a naturally occurring masonry surface.

Plural slotted receivers 124, are positioned along the lower perimeter surfaces in the first and second surfaces 110, 112 for being engaged by pins 122 positioned along the perimeter of the fourth surface 114. In addition, slotted receivers 124 are located along the outer edges of the first and second surfaces 110, 112 for engagement by pin mechanisms 120 located in the third surfaces 116. The third surfaces 116 also contain slotted receivers 124 securing the third surfaces 116 to the fourth surface 114. The third surfaces 116 are also illustrated having an incline structure with an upper edge oriented inwardly for providing a tapered edge to the masonry material. A taper within the masonry material may allow for varying orientation of masonry blocks within the retaining wall, the wall conforming to the desired curvature of the surrounding landscape with individual blocks being rotated in relation to one another.

The elongated spacer 138 shown in FIG. 15 has a catch structure 146 extending outwardly and adapted for being received by the reinforced structure 130. The catch structure 146 supports the vertical leg 132 of the reinforced structure 130 while a stabilizing arm 148 extends along the elongated spacer 138 maintaining the reinforced structure 130 in an upright position while the masonry material cures or hardens.

FIG. 16 illustrates the masonry form 102*b* in a closed position having an alternatively configured first surface 110*a* with a spaced insert 140*a*, the first and second surfaces 110*a*, 112 being generally adapted for forming the second masonry block 20 with the recessed portion 58 illustrated in FIG. 4. The spaced insert 140*a* is generally rectangular, located above the concentric receiver 136, spanning the third surfaces 116 along the first surface 110*a*. FIG. 16 also illustrates the elongated spacer 138 received by the reinforcement structure 130, the catch structure 146 adjusting the vertical leg 132 in an upright position.

Figure 18:
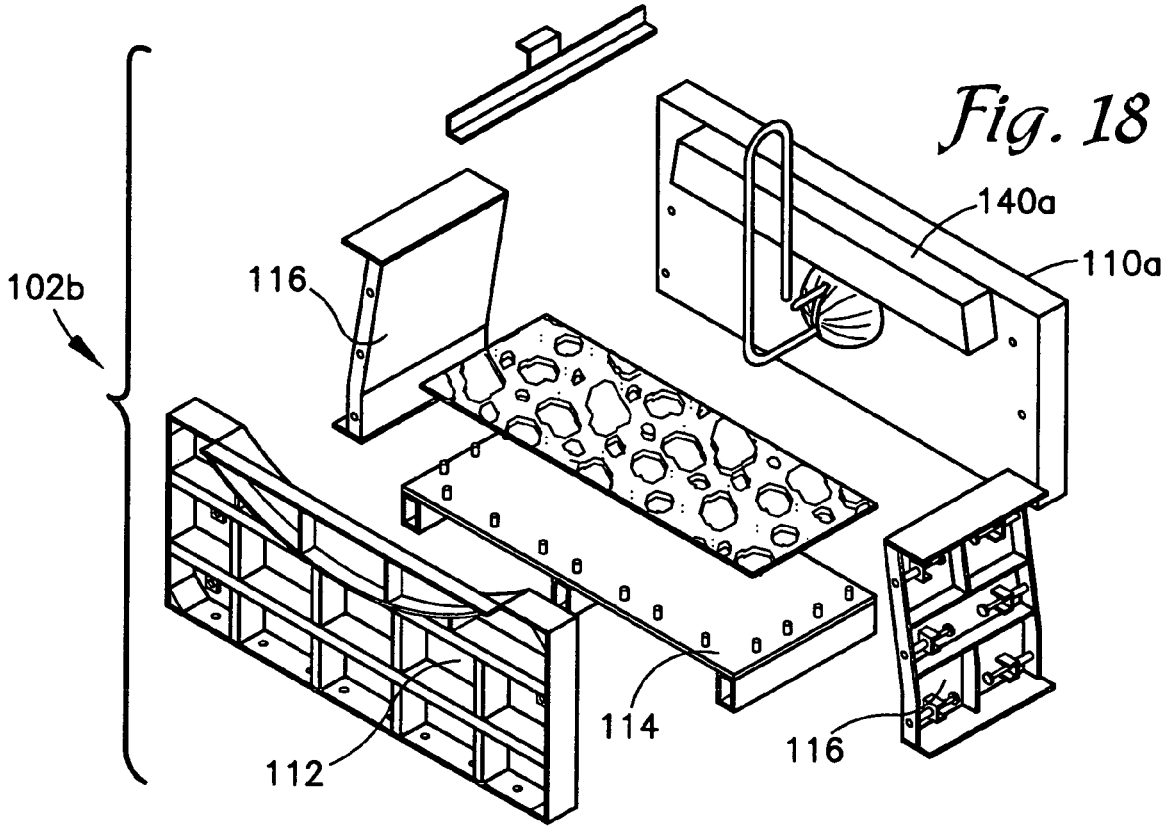
FIG. 18 is an exploded perspective view of the middle block masonry mold shown in FIG. 16.
Figure 19:
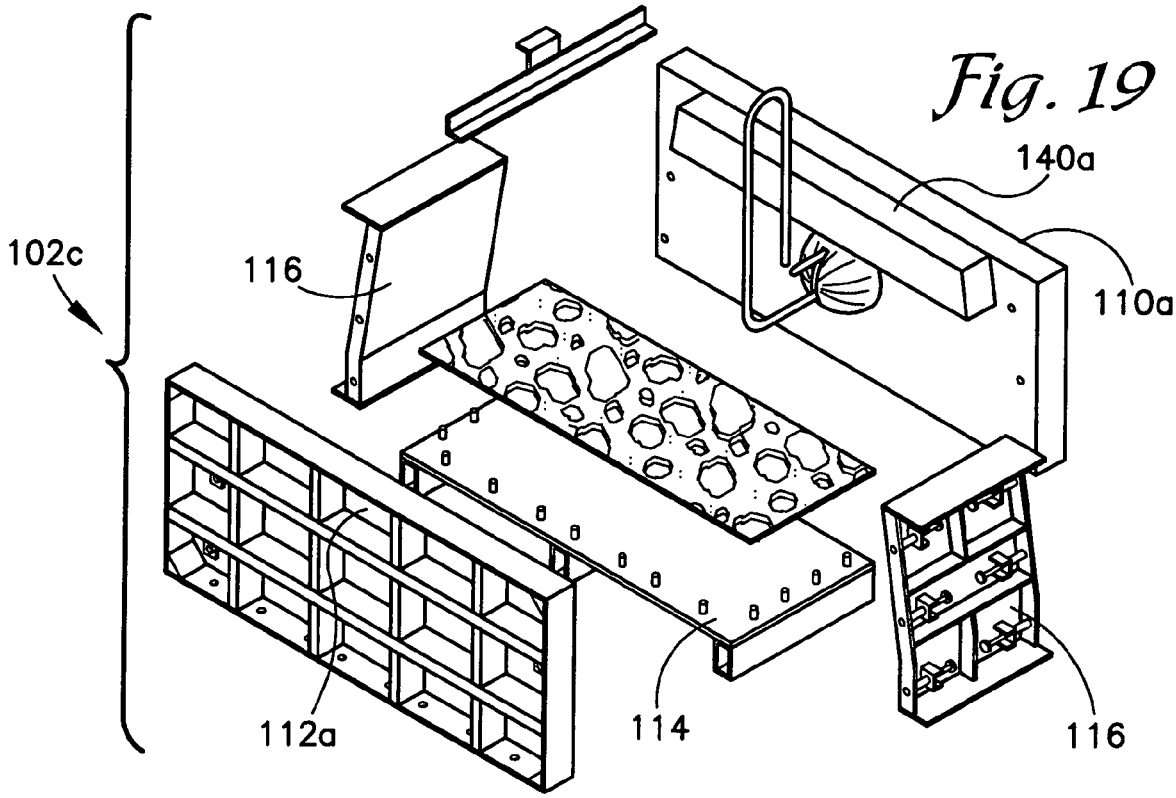
FIG. 19 is an exploded perspective view of the bottom block masonry mold shown in FIG. 17.

FIG. 17 illustrates the masonry form 102*c* having an alternatively configured second surface 112*a* utilizing a substantially planar surface, while the alternatively configured first surface 110*a* utilizes the spaced insert 140*a* the first and second surfaces 110*a*, 112*a* being generally adapted for forming the masonry block 30 including the recessed portion 58 as illustrated in FIG. 6. FIGS. 18 and 19 illustrate exploded views of the masonry forms 102*b*, 102*c* illustrated in FIGS. 16 and 17. FIG. 18 illustrates the form 102*b* including the alternative first surface 110*a* having the spaced insert 140*a* with the second surface 112 and FIG. 19 illustrates the form 102*c* including the alternative first surface 110*a* having the spaced insert 140*a* with the alternative second surface 112*a*.

FIGS. 20 and 21 illustrate the masonry form 102*d* having an alternatively configured first surface 110*b* with a spaced insert 140*b* generally adapted for forming the alternative masonry block 80 illustrated in FIGS. 8 and 9, having two upwardly extending ledges 19, 70 separated by the fluid receiving structure 72. FIG. 20 illustrates the masonry form 102*d* in the closed position while FIG. 21 illustrates an exploded view of the masonry form 102*d*. The spaced insert 140*b* generally provides a joint 128 located between the cavity 118 opening and the spaced insert 140*b* for receiving masonry material, the joint 128 being generally adapted for forming the ledge 70 illustrated in FIG. 8. FIG. 21 also indicates the form 102 optionally including a hinged connection 126 between the first and fourth surfaces for easy removal of the formed masonry material. The spaced insert 140*b* may be further configured by reducing the width of the insert 140*b* to provide for at least one side joint located between either one or both of the third surfaces 116, the side joint generally adapted for forming the upwardly extending side ridge 82 spanning the upwardly extending ledges 19, 70 in the masonry block 80 as illustrated in FIGS. 22 and 23.

In operation and referring back to FIGS. 1, 10, 11, 14 and 15 the masonry form 102*a* is configured with the fourth surface 114 optionally receiving the masonry plate 144, the first and second surfaces 110, 112 being secured to the third surfaces 116, the first surface 110 is configured with the spaced insert 140, the reinforcement structure 130 extending through the cavity 118 bounded by the first, second, third and fourth surfaces, 110, 112, 116, 114 and secured to the concentric receiver 136. The second surface is configured with the recessed portion 142. Masonry material is then received by the cavity 118 within the form 102*a*, the masonry material curing. After curing the surfaces 110, 112, 114, 116 are separated and the configured first block 10 is removed from the masonry form 102*a* utilizing the vertical leg 132 of the reinforcement structure 130.

The masonry form 102*b* illustrated in FIG. 16 is configured with the first and second surfaces 110*a*, 112 being secured to the third surfaces 116, the first surface 110*a* is configured with the spaced insert 140*a*. The second surface is configured with the recessed portion 142. Masonry material is then received by the cavity 118 within the form 102*b*, the masonry material curing. After curing the surfaces 110*a*, 112, 114, 116 are separated and the configured second block 20 is removed from the masonry form 102*b* utilizing the reinforcement structure 130.

The second block 20 is then positioned on a generally horizontal surface using the horizontal leg 134 which corresponds to the upper surface rebar structure 142. The first block 10 is then aligned such that the depending lip 152 formed from the first surface 110 is aligned with the recessed portion 158 of the second block 20 using the reinforcement structure 130 extending through the first block 10. The rear surface reinforcement structure or bar 144 corresponds to the vertical leg 132 of the reinforcement structure 130. The depending lip 152 of the first block 10 rotatably engages the recessed portion 158 about the rotational axis 136 of the second block 20. As plural blocks 10, 20 are arranged in the retaining wall structure 2, the blocks are rotated about the upright axis 134, the wall 2 adjusting the contour of the surrounding earth 4.

Figure 25:
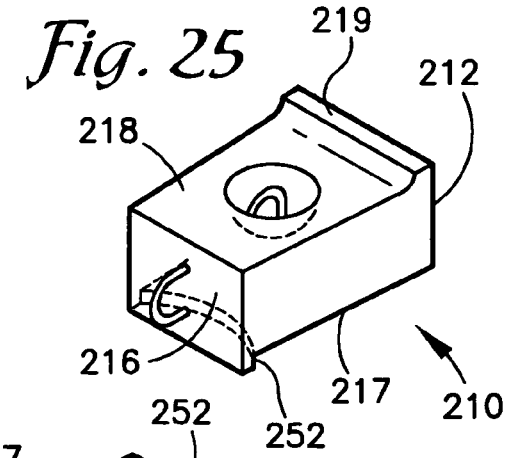
FIG. 25 is a rear perspective view of an alternative top masonry block in accordance with the present invention.
Figure 26:
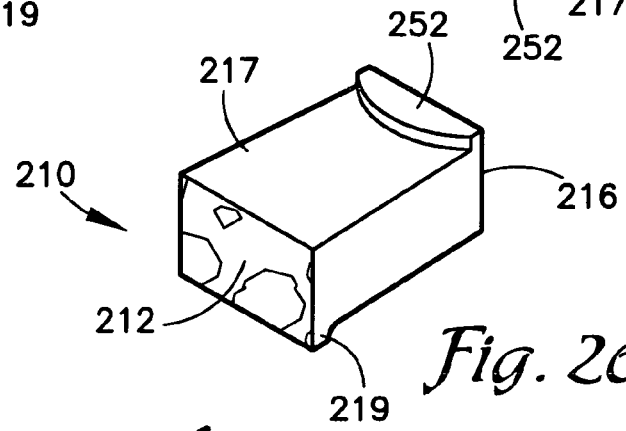
FIG. 26 is a front perspective view of the underside of the top masonry block as shown in FIG. 25, the top block having a masonry relief illustrated on the front surface thereof.

Alternative half-block configurations are illustrated in FIGS. 25-26, 28-29, and 31-32. Generally, a first half-block 210 is depicted in FIGS. 25-26 having similar features to the first block 10 illustrated in FIGS. 2-3 including a front surface 212, a rear surface 216, a bottom surface 217, an upper surface 218, a ledge 219 extending from the upper surface 218 and a depending lip 252 extending from the bottom surface 217. A second half-block 220 depicted in FIGS. 28-29 has similar features to the second block 20 illustrated in FIGS. 4-5 including a bottom and upper surfaces 227, 228, a recessed portion 258 with an inwardly facing edge 260 extending from the upper surface 228, with the depending lip 252 extending from the bottom surface 227 and associated with a rear surface 226 opposite a front surface 222 which optionally includes a masonry relief. A third half-block 230 depicted in FIGS. 31-32 has features similar to the third block 30 illustrated in FIGS. 6-7 including the recessed portion 258 associated with an upper surface 238, a substantially planar bottom surface 237 and a rotational axis 236.

The half-blocks 210, 220, 230 have a width which in comparison to the width of the first, second and third blocks 10, 20, 30, is generally half, the half-width blocks 210, 220, 230 being adapted, for example but not limited to a retaining wall where there is insufficient space to use the first, second or third blocks 10, 20, 30. The first half block 210 is adapted for rotation while overlying another block such as the second or third half-block 220, 230 or for overlying the second or third block 20, 30. The second half-block 220 is adapted for both receiving an overlying block such as but not limited to the first block 10, the first half-block 210, the second block 20, the second half-block 220 or for overlying another block such as but not limited to the second block 20, the second half-block 220, the third block 30 or the third half-block 230. The third half-block 230 is adapted for overlying the earth 4 and for receiving another block such as the first 10, second 20, first half 210 or second half-block 220 which may be rotated about the third half-block 230.

Figure 27:
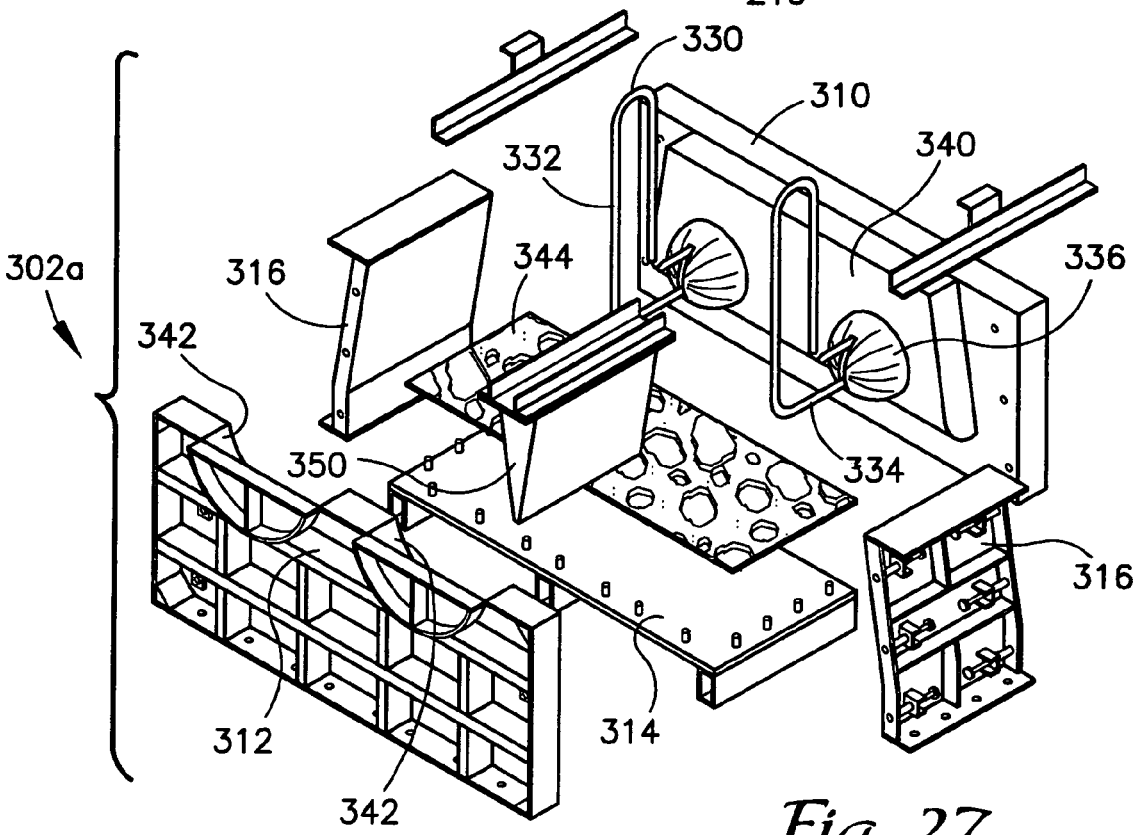
FIG. 27 is an exploded perspective view of an alternative top block masonry mold in accordance with the present invention.
Figure 33:
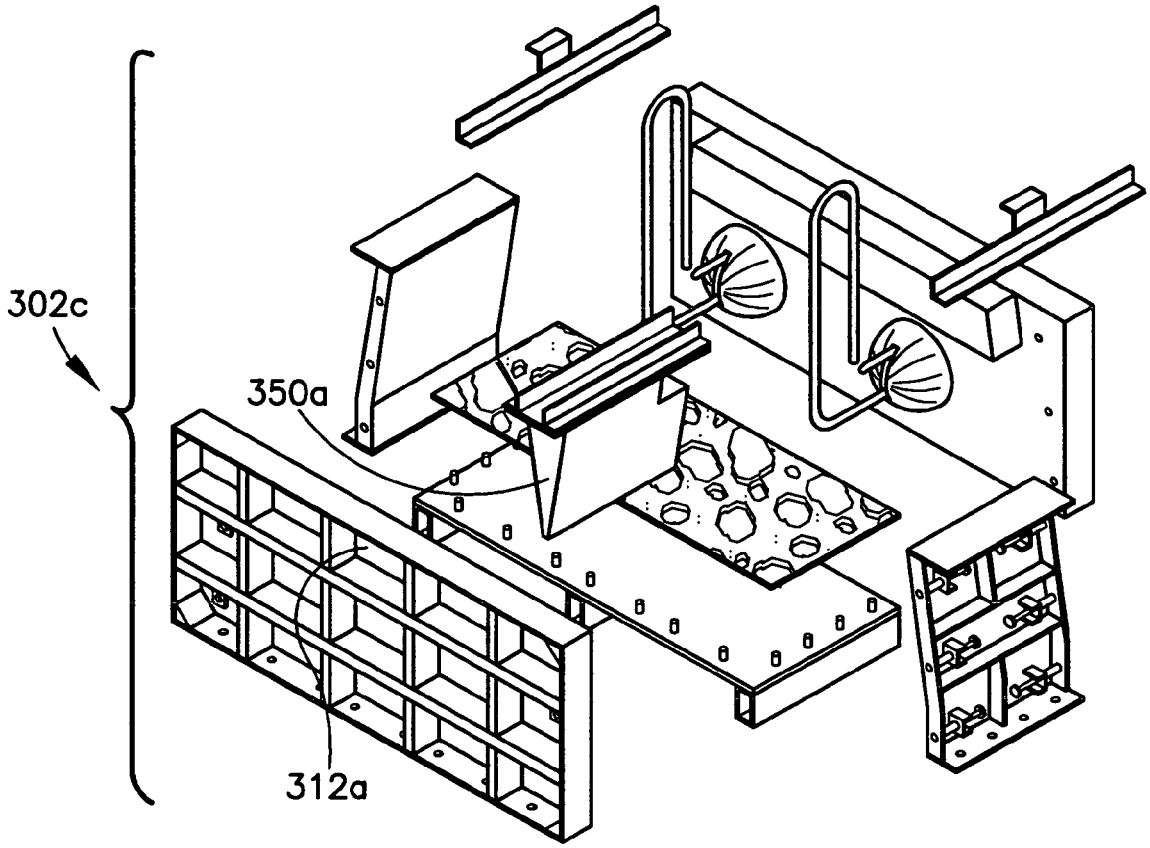
FIG. 33 is an exploded perspective view of an alternative bottom block masonry mold in accordance with the present invention.

Alternatively configured masonry forms are provided in FIGS. 27, 30 and 33 in which a divider is received by a cavity (not shown) formed by a first 310, second 312, third 314 and fourth surfaces 316. The form 302A is generally adapted for receiving masonry material within the cavity and is illustrated in FIG. 27 with a configuration for providing a pair of masonry blocks such as but not limited to the half-blocks 210, 220, 230 illustrated in FIGS. 25-26, 28-29, 31-32. The form 302A includes at least one reinforcement structure 330 having a vertical and a horizontal leg 332, 334, the horizontal leg 334 extending from a concentric receiver 336 illustrated as being located on a spaced insert 340 associated with the first surface 310. The second surface 312 provides a pair of non-linear generally arcuate recesses 342 located near the cavity opening opposite the third surface 314. A divider 350 received by the form 302A between the first and second surfaces 310, 312 generally bisects the cavity into plural masonry receiving compartments defined by the divider 350 and the first, second, third and fourth surfaces 310, 312, 316, 314. The form 302A also includes an optional relief plate 344 for providing a masonry relief to the masonry material. The divider is positioned adjacent to the spaced insert 340 having a complementary shape in connection with the spaced insert. In addition, the divider includes a tapering edge for tapering the shape of the received masonry material.

The form 302B illustrated in FIG. 30 is illustrated with an alternative spaced insert 340*a* associated with the first surface 310, the spaced insert 340*a* adapted for providing a recessed surface within the masonry material such as the recessed surface 258 depicted in FIG. 31. In addition an alternative divider 350*a* is illustrated with a complementary structure adapted for communication with the spaced insert 340*a*. In FIG. 30, the complementary structure represents a slot within the divider 350*a* adapted for receiving the spaced insert 340*a*. Plural concentric receivers 336 are illustrated in association with the first surface 310, the concentric receivers 336 receiving reinforcement structures 330. The form 302C illustrated in FIG. 33 includes an alternative substantially planar second surface 312*a* adapted for providing a substantially planar bottom surface such as the bottom surface 237 in FIG. 31.

It should be understood that while certain forms of this invention have been illustrated and described, it is not limited thereto except insofar as such limitations are included in the following claims.

Having thus described the invention, what is claimed as new and desired to be secured by Letters Patent is as follows:

1. A wall structure for use in landscaping and comprising:

a lower block having a first front surface, a first rear surface, and opposite first side surfaces, said lower block having a substantially planar upper surface with a single recess having an open rear end and extending substantially from said first rear surface to a rear facing edge formed thereby and directed toward said first rear surface;

said rear facing edge extending horizontally from said first rear surface;

an upper block having a second front surface, a second rear surface, and opposite second side surfaces, said upper block having a substantially planar lower surface with a curved and convex depending lip extending from said lower surface at said second rear surface and forming a single front facing edge directed toward said second front surface, said front facing edge proximate to said second rear surface;

said upper block being positioned on said lower block with said front facing edge engaged with said rear facing edge at a rearward zone of contact therebetween, said rearward zone of contact being presented at said first and second rear surfaces; and said upper block being set back and rotated about a rearward rotational axis of said lower block at said rearward zone of contact with said second front surface spaced angularly from said first front surface selected from a range of angles.

2. A structure as set forth in claim 1 wherein:

said front facing edge is curved and convex; and said rear facing edge is straight.

3. A structure as set forth in claim 1 wherein said upper block has a second upper surface including a second rear facing surface directed toward said second rear surface.

4. A structure as set forth in claim 1 and including:

a lower layer formed by a plurality of said lower blocks positioned in side-by-side relation;

each lower block having a first front surface, the first front surfaces of adjacent blocks having a selected angular relationship to form a selected contour of said lower layer;

an upper layer formed by a plurality of said upper blocks positioned in side-by-side relation on said lower layer;

each of said upper blocks having a second front surface, the second front surfaces of adjacent blocks having respective angular relationships to substantially match said selected contour of lower blocks therebelow; and each of said upper blocks engaging at least one of said lower blocks in a respective rearward zone of contact.

5. A structure as set forth in claim 4 wherein said upper blocks are staggered in relation to said lower blocks.

6. A wall structure for use in landscaping and comprising:

a lower block having a first front surface, a first rear surface, and opposite first side surfaces, said lower block having a flat upper surface with a single recess having an open rear end and extending from said first rear surface to form a rear facing edge directed toward said first rear surface and spaced closer to said first rear surface than to said first front surface, said rear facing edge being straight;

an upper block having a second front surface, a second rear surface, and opposite second side surfaces, said upper block having a flat lower surface with a depending lip extending from said second rear surface and forming a single front facing edge directed toward said second front surface and spaced closer to said second rear surface than to said second front surface, said front facing edge being curved and convex;

said upper block being positioned on said lower block with said front facing edge engaged with said rear facing edge at a rearward zone of contact therebetween;

said rearward zone of contact being presented at said first and second rear surfaces; and said upper block being rotated about a rearward rotational axis of said lower block with said second front surface at an angle relative to said first front surface selected from a range of angles.

7. A structure as set forth in claim 6 wherein said upper block has a second upper surface including a second rear facing surface directed toward said second rear surface.

8. A structure as set forth in claim 6 and including:

a lower layer formed by a plurality of said lower blocks positioned in side-by-side relation;

each lower block having a first front surface, the first front surfaces of adjacent blocks having a selected angular relationship to form a selected contour of said lower layer;

an upper layer formed by a plurality of said upper blocks positioned in side-by-side relation on said lower layer;

each of said upper blocks having a second front surface, the second front surfaces of adjacent blocks having respective angular relationships to substantially match said selected contour of lower blocks therebelow; and each of said upper blocks engaging at least one of said lower blocks in a respective rearward zone of contact.

9. A structure as set forth in claim 8 wherein said upper blocks are staggered in relation to said lower blocks.

10. A wall structure for use in landscaping and comprising:

a lower layer formed by a plurality of lower blocks positioned in side-by-side relation;

each of said lower blocks having a first front surface, a first rear surface, and opposite first side surfaces, said lower block having a flat upper surface with a single recess having an open rear end extending from said first rear surface to form a rear facing edge directed toward said rear surface and spaced closer to said first rear surface than to said first front surface, said rear facing edge being straight, the first front surfaces of adjacent lower blocks having a selected angular relationship to form a selected contour of said lower layer;

an upper layer formed by a plurality of upper blocks positioned in side-by-side relation on said lower layer;

each of said upper blocks having a second front surface, a second rear surface, and opposite second side surfaces, said upper block having a flat lower surface with a depending lip extending from said second rear surface and forming a front facing edge directed toward said second front surface and spaced closer to said second rear surface than to said second front surface, said front facing edge being curved and convex, the second front surfaces of adjacent blocks having respective angular relationships to substantially match said contour of lower blocks therebelow; and each of said upper blocks being positioned on at least one lower block with the front facing edge of the upper block engaged with said rear facing edge of said lower block at a respective rearward zone of contact therebetween, said upper block being rotated about a rearward rotational axis of said lower block with said second front surface of said upper block at an angle relative to said first front surface of said lower block, said angle being selected from a range of angles.

11. A structure as set forth in claim 10 wherein:

each of said upper blocks has a second upper surface including a second rear facing surface directed toward the second rear surface thereof.

12. A structure as set forth in claim 10 wherein:

said upper blocks are staggered in relation to said lower blocks.

13. A structure as set forth in claim 10 wherein:

at least a portion of said selected contour is straight.

14. A structure as set forth in claim 10 wherein:

at least a portion of said selected contour is curved.

* * * * *